US009498669B2

(12) United States Patent
Brizard et al.

(10) Patent No.: US 9,498,669 B2
(45) Date of Patent: Nov. 22, 2016

(54) RESISTANCE EXERCISE TRAINER HAVING PORTABLE HAND-HELD WEIGHTS

(76) Inventors: Cyril Brizard, Topanga Canyon, CA (US); Christopher Gilberti, West Los Angeles, CA (US)

( * ) Notice: Subject to any disclaimer, the term of this patent is extended or adjusted under 35 U.S.C. 154(b) by 118 days.

(21) Appl. No.: 13/295,366

(22) Filed: Nov. 14, 2011

(65) Prior Publication Data

US 2012/0058863 A1 Mar. 8, 2012

Related U.S. Application Data

(63) Continuation-in-part of application No. 12/543,384, filed on Aug. 18, 2009, now Pat. No. 8,109,863.

(51) Int. Cl.

| | |
|---|---|
| ***A63B 21/06*** | (2006.01) |
| ***A63B 21/065*** | (2006.01) |
| ***A63B 21/00*** | (2006.01) |
| ***A63B 21/072*** | (2006.01) |
| ***A63B 23/04*** | (2006.01) |
| *A63B 23/02* | (2006.01) |

(52) U.S. Cl.

CPC ..... *A63B 21/065* (2013.01); *A63B 21/0004* (2013.01); *A63B 21/0603* (2013.01); *A63B 21/072* (2013.01); *A63B 23/047* (2013.01); *A63B 21/4013* (2015.10); *A63B 21/4015* (2015.10); *A63B 21/4019* (2015.10); *A63B 23/0211* (2013.01); *A63B 23/0233* (2013.01); *A63B 23/0482* (2013.01); *A63B 23/0494* (2013.01); *A63B 2208/0257* (2013.01); *A63B 2209/10* (2013.01); *A63B 2210/50* (2013.01)

(58) Field of Classification Search

CPC ..... A63B 21/065; A63B 21/0603; A63B 21/06; A63B 21/1469; A63B 2209/10; A63B 21/1423; A63B 21/143

USPC ..... 482/92–93, 105–106, 139, 148, 910, 482/50, 74, 128–129; 190/102, 103, 115, 190/124; D21/196, 683; 383/42, 64, 85, 86, 383/88, 89, 93, 95

See application file for complete search history.

(56) References Cited

U.S. PATENT DOCUMENTS

| | | | | | |
|---|---|---|---|---|---|
| 3,111,317 | A | * | 11/1963 | Cituk | 473/444 |
| 3,417,415 | A | * | 12/1968 | Kozak | 441/58 |
| 3,924,851 | A | * | 12/1975 | Winston | 482/105 |
| 4,357,009 | A | | 11/1982 | Baker | |
| 4,684,123 | A | * | 8/1987 | Fabry | 482/105 |
| 4,695,051 | A | | 9/1987 | Jenison | |
| 4,966,365 | A | * | 10/1990 | Winston | 482/105 |
| 4,997,183 | A | * | 3/1991 | Winston | 482/105 |
| 5,076,575 | A | * | 12/1991 | Eylander | 482/105 |
| 5,085,320 | A | * | 2/1992 | Scott | 206/315.9 |

(Continued)

*Primary Examiner* — Loan H Thanh
*Assistant Examiner* — Andrew S Lo
(74) *Attorney, Agent, or Firm* — Kelly & Kelley, LLP

(57) ABSTRACT

The soft weight strength trainer includes a selectively fillable pouch with a strap positioned so that a person can fit a hand or foot in-between the strap and the fillable pouch. The soft weight strength trainer can be utilized in a variety of exercises that strengthen various muscle groups. None of the exercises that are performed with the soft weight strength trainer require a close fisted grip, which makes the soft weight strength trainer ideal for use by a person with reduced hand strength due to age or injury. Additionally, the soft weight strength trainer will not cause damage or injury if inadvertently dropped due to its non-rigid construction.

15 Claims, 9 Drawing Sheets

(56) References Cited

U.S. PATENT DOCUMENTS 5,127,891 A * 7/1992 Winston ..... 482/50
D339,838 S * 9/1993 Winston ..... D21/683
5,547,445 A * 8/1996 Chang ..... 482/105
5,725,458 A 3/1998 Newman et al.
5,797,823 A * 8/1998 Gouvis, II ..... 482/105
D413,367 S * 8/1999 Eckmann ..... D21/683
6,007,461 A * 12/1999 Winston ..... 482/55
6,022,144 A * 2/2000 Hausslein ..... B31B 19/60 383/33
6,113,521 A * 9/2000 Winston ..... 482/105
6,146,016 A * 11/2000 Mucci ..... B65D 33/06 383/121.1
6,149,555 A * 11/2000 Kinback ..... 482/93
6,200,243 B1 * 3/2001 Meranto ..... 482/105
6,224,517 B1 * 5/2001 Dereszynski ..... 482/93
6,332,712 B1 * 12/2001 Headley ..... B65D 31/06 383/104
6,652,421 B1 * 11/2003 Chen ..... 482/49
D494,233 S * 8/2004 Kerry ..... D21/662
D498,799 S * 11/2004 Kerry ..... D21/662
6,898,802 B1 * 5/2005 Suarkeo ..... 2/20
7,022,095 B2 * 4/2006 Schneider ..... 602/64
D526,691 S * 8/2006 Fu ..... D21/683
7,469,809 B2 * 12/2008 Rodarte et al. ..... 224/578
7,908,672 B2 * 3/2011 Butler ..... 2/162
8,051,540 B2 * 11/2011 Gallant ..... A44B 18/0003 24/30.5 R
2004/0008908 A1 * 1/2004 Shepard ..... B65D 33/24 383/89
2004/0043875 A1 * 3/2004 Lederfeind ..... 482/105
2004/0049837 A1 * 3/2004 Falconer ..... A61F 5/4407 4/144.1
2004/0132589 A1 * 7/2004 Zajac et al. ..... 482/105
2004/0219988 A1 * 11/2004 Park et al. ..... 473/256
2005/0187075 A1 * 8/2005 Bellamy ..... 482/93
2005/0230384 A1 * 10/2005 Robison ..... A47J 36/022 219/730
2005/0263556 A1 * 12/2005 Labit et al. ..... 224/610
2008/0108482 A1 * 5/2008 Macey ..... 482/23
2009/0062093 A1 * 3/2009 Clark ..... 482/148
2010/0021090 A1 * 1/2010 Wilske ..... A45C 11/20 383/42
2010/0270317 A1 * 10/2010 Kieling ..... A45C 3/001 220/592.25
2010/0311551 A1 * 12/2010 Winston ..... 482/105
2011/0319235 A1 * 12/2011 Garrett ..... 482/105
2012/0052161 A1 * 3/2012 Woodham ..... B65D 31/10 426/106

* cited by examiner

RESISTANCE EXERCISE TRAINER HAVING PORTABLE HAND-HELD WEIGHTS

BACKGROUND OF THE INVENTION

The present invention relates to a soft weight strength trainer and related strength training process. More particularly, the present invention relates to a soft strength trainer that can be filled with a variety of low density granular components which can be emptied out later when the strength trainer is no longer in use.

The popularity of training devices designed to improve athletic performance such as strength, speed and endurance have increased in popularity in recent years for both professional and amateur athletes. Accordingly, a wide variety of equipment and training regimens have been devised for athletes having a variety of skill levels. Training equipment has been designed for athletes involved in a variety of sports that include soccer, football, hockey, track and field, basketball, baseball, swimming, etc. The training devices are devised to improve physical performance by applying a drag force, weight or other impedance to the athlete during an exercise or training regimen. Weight trainers are specifically designed to add weight to motions performed by the user with various parts of his body. By adding extra weight to these motions, the user's muscles must work harder than they otherwise would. In this way, the user's muscles become stronger and more defined.

One example of such a training device includes standard metal or plastic weight trainers. These weight trainers are rigidly formed and are generally shaped with a handgrip and two counterbalanced, weighted plates. The weighted plates may be integrally formed with the weight trainer or they may be removable. The handgrip may be gripped by one hand, or it may be wide enough for a two handed grip. Such rigidly formed weight trainers are problematic in that they can be difficult to grip properly. Older users, or users with hand problems may have a hard time developing the necessary grip strength required to properly grip a weight trainer. If a user does not have a good grip on the weight trainer, he is liable to drop the weight trainer on himself or on something else. Because the weight trainer is heavy and rigid, there exists the possibility that the user might seriously injure himself if he drops the trainer on some part of his body. Similarly, when a heavy weight trainer is dropped onto something else, like the floor or a bench, further damage may ensue. In addition to concerns regarding damage and injury, a traditional rigid weight trainer is not suitable for travel. A traditional weight trainer may be too large to fit in luggage, and it would make the luggage (which may already be heavy) even heavier.

A soft weight trainer addresses the problems associated with traditional rigid weight trainers. A soft weight trainer, as will be described here, does not require a specific type of hand grip in order to be used. Additionally, a soft weight trainer is deformable. This means that it is less likely to cause damage or injury when dropped. Finally, a soft weight trainer is filled with low density granular components can be designed so that the weight trainer can be emptied when not in use. Similarly, when the user desires to travel with his soft weight trainer, he can empty the soft weight trainer thereby reducing both the size and weight of the trainer. In this way, the soft weight trainer can be taken on a trip without adding to the bulk of the user's luggage.

Prior art soft weight trainers do not provide the advantages of the current invention. The most common type of soft weight trainer is exemplified in U.S. Pat. No. 5,725,458 to Newman et al. Newman claims an apparatus that comprises a stand from which heavy bags are hung. These bags are used for boxing and kickboxing exercises. This is unlike what is taught by the current invention in that the bags utilized by Newman are not movable, but are permanently attached to the stand.

Other prior art soft weight trainers include fillable bags such as in U.S. Pat. No. 4,357,009 to Baker. Baker claims a water-filled apparatus that is strapped onto a user's leg and foot. The user then performs exercises with this extra weight on his leg. Another similar soft weight trainer is U.S. Pat. No. 4,695,051 to Jenison. The Jenison trainer is a water-filled, collapsible dumbbell. When filled, the dumbbell resembles a traditional weight trainer with to weighted ends connected by a central bar. The user grips the central bar to perform exercises. Both of these soft weight trainers do not teach the limitations of the current invention. Unlike Baker, the current invention does not need to be strapped on to any part of the user in order to be used. And unlike Jenison, the current invention can be used by a user who does not have the required grip strength to grip a central bar.

The prior art also includes U.S. Pat. No. 6,149,555 to Kinback. Kinback discloses a variable weight exercise bag. This exercise bag features two side handles and fill tube. The side handles are made from PVC, plastic or cardboard tubing, or hose. The exercise bag is filled through the fill tube which is then folded over in order to hold the fill material. The fill tube is preferably secured with hook and loop material. The Kinback bag can also be used with a belt, grommets, or other cut outs. Unlike the Kinback bag, the soft weight trainer of the current invention does not feature any belts, grommets, or cut outs. Additionally, the current invention does not have hard handles that require a close-fisted grip like those taught by Kinback.

There exists, therefore, a significant need for a soft weight trainer that has no hard pieces that can be filled with variable weight material. The present invention fulfills these needs and provides further related advantages.

SUMMARY OF THE INVENTION

The current invention is a soft weight that can be filled with a variety of low density granular components such as sand, dirt, rice, beans, silica, salt, or other types of fine mesh fillers. When not in use, the weight shell can be emptied and stored or packed for travel. The soft weight is very light in its empty state which makes it ideal for shipping, unlike traditional metal weights.

The soft weight of the current invention is made from waterproof material that is suitable for both indoor and outdoor use. The waterproof material ensures that the low density granular material inside the soft weight does not absorb excess moisture which would cause caking. Additionally, the soft weight of the current invention features a more ergonomic grip than traditional metal weight trainers. The ergonomic grip of the current invention is a strap that does not require a close hand grip around a narrow metal bar which can be stressful to the hands of a user who has arthritis or joint problems. The strap is preferably made of webbing but can be made of any material that allows the user's hands to be placed through.

The filled soft weight can be used by individuals of all ages. If the soft weight is un-expectantly dropped, the user is in no danger of being injured as he otherwise would with traditional metal weights. Similarly, the user does not have to fear for his flooring or other surfaces which may be damaged by a dropped weight.

The soft weight of the current invention also features a unique double Velcro™ (hook and loop tape) seal. The soft weight can effectively hold the low density fillers because of this double Velcro™ seal. The double Velcro™ seal comprises two parallel Velcro™ strips that fold on top of each other. The first Velcro™ strip closes the opening of the soft weight to retain the low density fillers. The second Velcro™ strip functions as an added safety measure. If the soft weight is dropped or submitted to extra pressure, the second Velcro™ strip will prevent the soft weight from opening and losing its fillers.

The soft weight of the current invention can be used in a wide variety of resistance training options. It can be used by placing hands through the straps and then doing conventional free weight resistance training exercise. The soft weight may also be used by being placed directly in contact with various parts of the body for added resistance training options. For example, the soft weight can rest on the user's shoulders for increased resistance in squat exercises. Additionally, the soft weight can be placed across the user's chest, thereby adding extra resistance to a sit-up. One soft weight can rest atop the user's feet to increase resistance while the user performs exercises with his lower abdominal muscles. Back exercises are performed by placing the soft weight behind the user's neck and contracting the back muscles while the user is on his stomach. Finally, because of the size and position of the webbed strap, users can slip their feet through the strap and do frontal leg lifts in order to exercise the quadriceps muscles.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
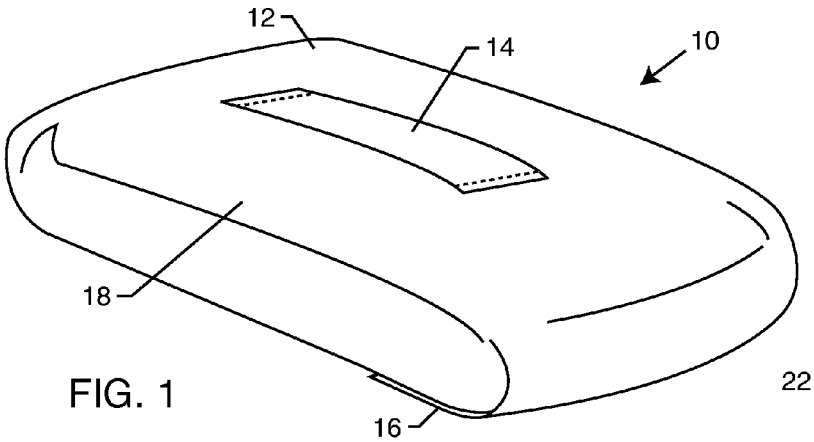
FIG. 1 is a perspective view of a refillable soft weight trainer.

As shown in the drawings for purposes of illustration, the present invention for a soft weight trainer is referred to generally by the reference number 10. In general, the soft weight trainer 10 includes a pouch 12 with a strap 14 and a selectively sealable sleeve 16. Exercises associated with the soft weight trainer 10 may vary depending on use and the desired workout routine. For example, raising and lowering the soft weight trainer 10 with various parts of the body provides efficient, effective and proven strength training. The soft weight trainer 10 and related strength training techniques appeal to both young and old athletes in, for example, primary schools, second schools, high schools, colleges, universities and professional athletics. Additionally, the soft weight trainer 10 is particularly useful for users who lack hand grip strength due to age or injury who cannot form a close-fisted grip. Use of the soft weight trainer 10 allows such athletes to train without the risk of injury and other inconveniences of the aforementioned resistance devices provided in the prior art.

Figure 2:
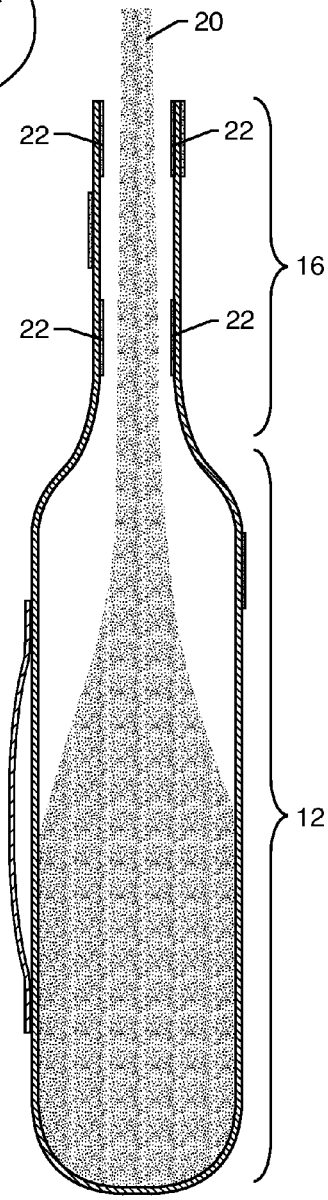
FIG. 2 is a cross-sectional view illustrating filling the soft weight trainer through a sleeve.
Figure 3:
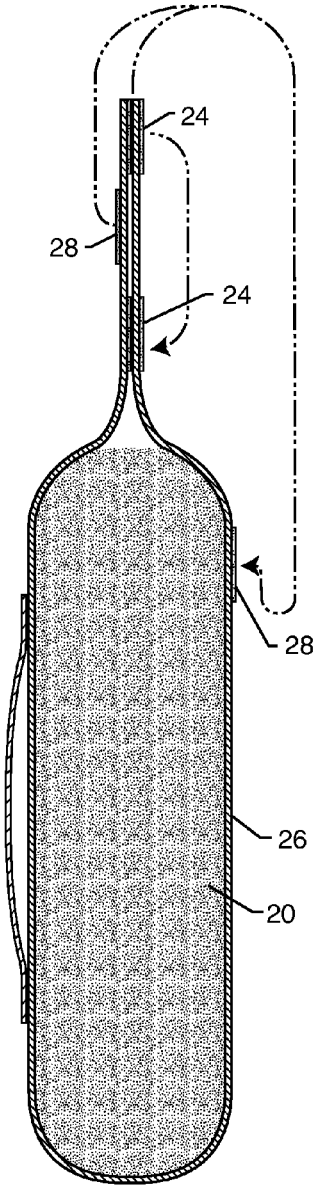
FIG. 3 is an alternative cross-sectional view of FIG. 2, illustrating the double seal that closes the soft weight trainer.
Figure 4:
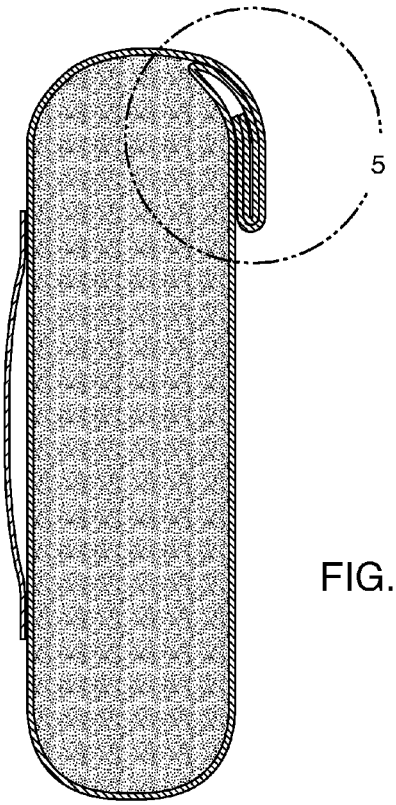
FIG. 4 is another cross-sectional view of the soft weight trainer of FIG. 2, illustrating the sleeve double sealed to the encasement of the soft weight trainer.
Figure 5:
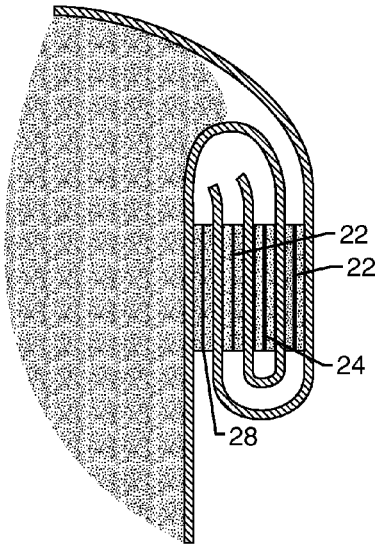
FIG. 5 is an enlarged view taken about the circle 5 in FIG. 4, illustrating the sleeve double sealed to the encasement of the soft weight trainer.

FIG. 1 illustrates a preferred embodiment of the soft weight trainer 10 having a pouch 12, a selectively sealable sleeve 16, and a strap 14 stitched to the upper surface 18 of the pouch. In this embodiment, the selectively sealable sleeve 16 enables a user to fill or empty the low density granular material 20 into or out from the interior of the pouch 12. The process for filling and sealing the soft weight trainer 10 is generally shown in FIGS. 2-5. FIG. 2 illustrates a preferred embodiment wherein the selectively sealable sleeve 16 is open and receiving the low density granular material 20 therethrough. Once the pouch 12 is filled with the low density granular material 20 to approximately the sleeve 16, each side of the sleeve 16 is moved inwardly so a pair of the internal sealers 22 can engage one another to seal off the interior of the pouch 12 in the manner shown in FIG. 3. The internal sealers 22 may include any mechanism known in the art for attaching one side of the sleeve 16 to the other, such as zippers. Preferably, the internal sealers 22 provide a water and air tight seal to prevent any of the granules 20 from escaping from within the interior of the pouch 12. When the pouch 12 is filled with sand, it is important that the internal sealers 22 lock out water or moisture to ensure that the sand does not "cake" or otherwise retain water weight. It is especially important that the internal sealers 22 are water tight when the pouch 12 is filled with water. Two sets of the internal sealers 22 are shown with respect to FIGS. 2-5, but a person of ordinary skill in the art will readily recognize that multiple sets of internal sealers 22 may be used with the soft weight trainer 10 depending on the desired application. For example, additional internal sealers 22 may be needed in the event that the soft weight trainer 10 can retain more than ten pounds of weight, and less internal sealers 22 may be required if the soft weight trainer 10 holds less than ten pounds of weight.

The sleeve 16 also includes a pair of external sealers 24. The sleeve 16 is long enough such that it may fold upon itself wherein one external sealer 24 may engage the other external sealer 24, as shown along the first directional arrow in FIG. 3. This feature further ensures that the contents of the soft weight trainer 10 remain securely retained therein. By bending the sleeve 16 to engage the external sealers 24, the granular material 20, in the preferred embodiment, are essentially choked off from disengaging both of the internal sealers 22. This is particularly preferred as the size and weight of the soft weight trainer 10 may cause significant pressure and stress along the surface where the internal sealers 22 are located to connect opposite sides of the sleeve 16. The external sealers 24 may comprise a set of complementary hook and loop fasteners, buttons, snaps or other clips for retaining a portion of the sleeve 16 to itself at an approximate ninety degree angle. The seal formed by the external sealers 24 does not necessarily need to be water or air tight as this desirable characteristic is already being performed by the internal sealers 22. Without the external sealers 24, disconnection of the internal sealers 22 may otherwise cause immediate loss of the contents of the soft weight trainer 10. This is particularly undesirable when the fill material 20 that the soft weight trainer 10 is retaining is dry granules. Moreover, the sleeve 16 may fold over and attach to a bottom surface 26 of the soft weight trainer 10 as shown generally in FIG. 4 and more specifically shown in FIG. 5. In this regard, the sleeve 16 is configured to double and triple seal the granules 20 within the enclosure of the soft weight trainer 10. To accomplish this, the sleeve 16 further includes a body sealer 28 that folds over and engages a similar body sealer 28 attached to the bottom surface 26 of the soft weight trainer 10, as shown along the second directional arrow in FIG. 3. The body sealers 28 retain the sleeve 16 along the exterior of the soft weight trainer 10. This ensures that the fillable soft weight trainer 10 shown in FIGS. 2-5 retains a substantially contoured shape (best shown in FIG. 4) similar to that of the soft weight trainer 10 illustrated in FIGS. 8-9. The triple seal of the sleeve 16 is best shown in the enlarged view of FIG. 5. The body sealers 28 may further be used to prevent any of the contents, e.g. the granules 20, from escaping out from within the interior of the soft weight trainer 10. The body sealers 28 do not necessarily form a water tight or air tight seal, but may include any of the sealing mechanisms described above with respect to the internal sealers 22 or the external sealers 24.

Figure 6:
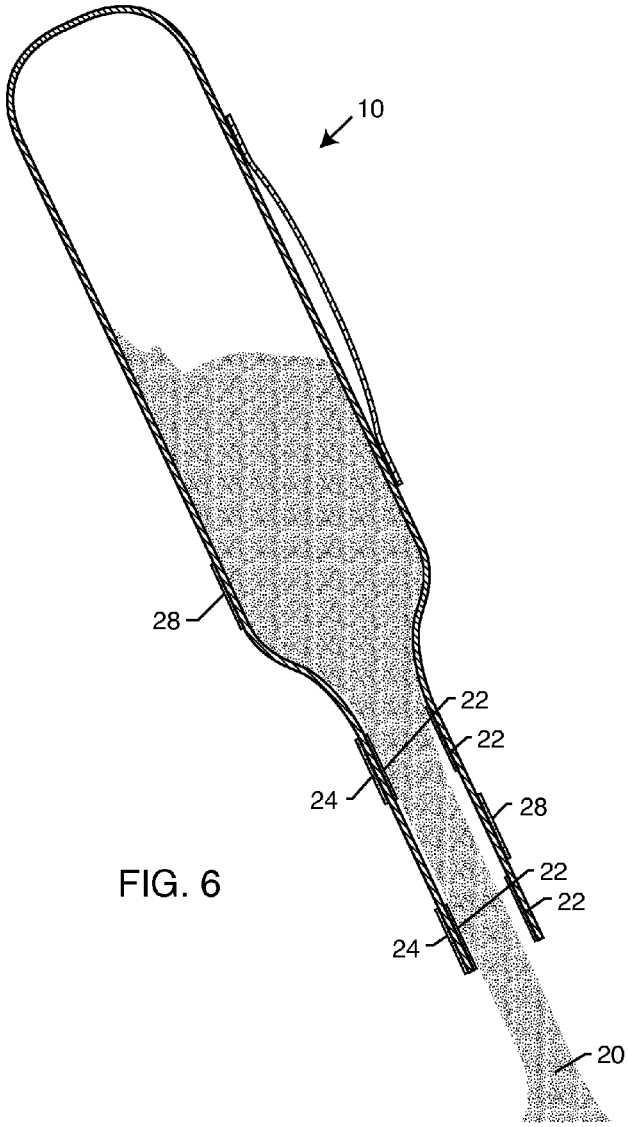
FIG. 6 is a side view of the bag, illustrating the soft weight trainer in an open position while being emptied.
Figure 7:
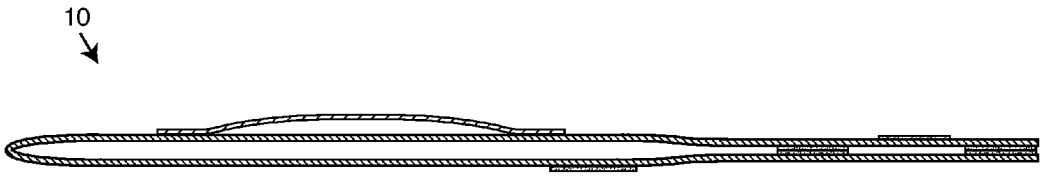
FIG. 7 is a side view of the soft weight trainer, illustrating the soft weight trainer emptied of all fillers.

FIG. 6 illustrates how granular material 20 is removed from the soft weight trainer 10. First, the body sealers 28 are disengaged such that the sleeve 16 is no longer attached to the bottom surface of the pouch 26. Next, the external sealers 24 are disengaged so that the sleeve 16 is no longer folded on itself. Finally, the internal sealers 22 are disengaged so that the sleeve 16 is open. With the sleeve 16 open, the soft weight trainer 10 can be tilted and the fill material 20 is emptied from the pouch 12 through the open sleeve 16. Once emptied, the soft weight trainer 10 is substantially flat, as shown in FIG. 7. A soft weight trainer 10 that has been emptied is well suited for storage or travel because without any filler material 20, the soft weight trainer 10 is small, lightweight, and foldable.

Figure 8:
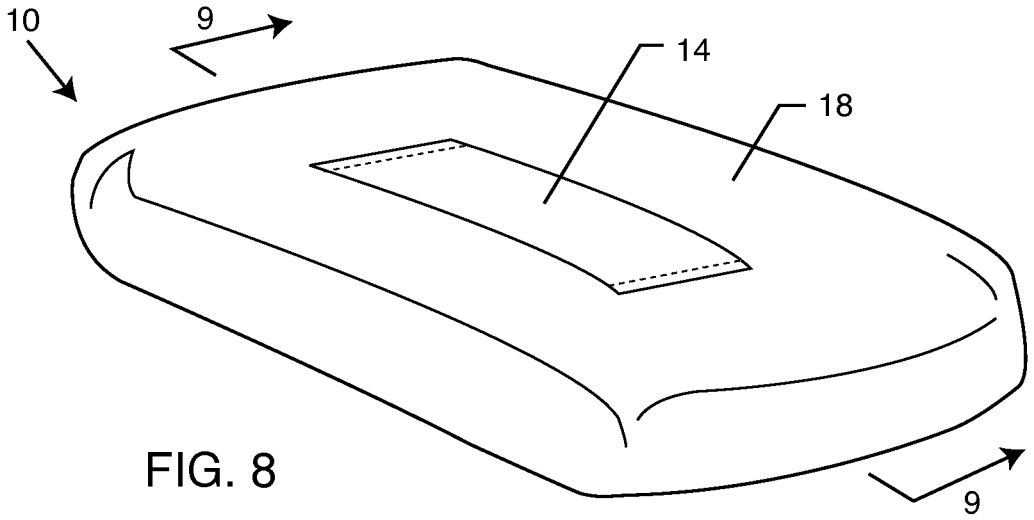
FIG. 8 is a perspective view of a pre-filled soft weight trainer.
Figure 9:
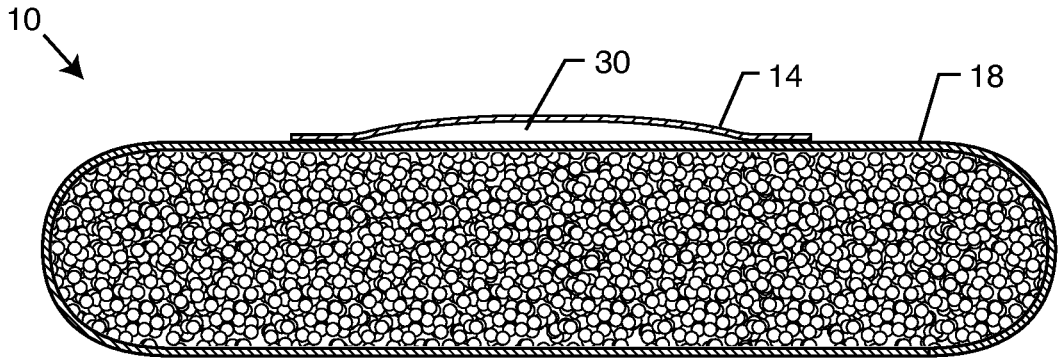
FIG. 9 is a cross-sectional view of the pre-filled soft weight trainer taken about the line 9-9 in FIG. 8, illustrating a plurality of granules within the pre-filled soft weight trainer.

FIG. 8 illustrates the soft weight trainer 10 that has been pre-filled. Such a pre-filled soft weight trainer 10 does not feature a sleeve with internal sealers 22, external sealers 24, or body sealers 28. In this embodiment, the soft weight trainer 10 is pre-bagged with ten pounds of the dry granules 20 packaged in thick heat-sealed poly-bags designed to prevent accidental spillage of the contents therein. The dry granules 20 may also comprise pellets or other low-density beads known in the art. The filled poly-bag weights are then inserted into a strong material bag manufactured from reinforced vinyl, canvas, ballistic material, etc. The strap 14 is stitched to the upper surface 18 of the material bag to allow convenient handling or gripping while performing an exercise regimen. The poly-bag may also be filled with any quantity of the granules 20 to vary the weight of the soft weight trainer 10. For example, the soft weight trainer 10 may be specifically manufactured to retain two, five, ten or twenty pounds of the granules 20. The choice of using the dry granules 20 as opposed to sand is to lessen the density of the load in the soft weight trainer 10. Sand can retain moisture and thereafter "cake", which makes the sand denser and adds water weight. The dry granules 20 refrain from caking, clumping and/or retaining additional moisture. Thus, if the soft weight trainer 10 is accidentally dropped, e.g. on a foot, the dry granules 20 are capable of dispersing at the point of impact (lowering the density thereof) thereby substantially reducing the risk of injury due to such accidents. In this embodiment, the soft weight trainer 10 that is pre-filled can be utilized in much the same way as the soft weight trainer 10 of the preferred embodiment that can be selectively filled. The only difference is that the soft weight trainer of FIG. 8 cannot be selectively filled or emptied. FIG. 9 illustrates a cross-sectional view of the soft weight trainer 10 that has been pre-filled and the positioning of the strap 14 relative to an upper surface 18 thereof. The strap 14 shown in FIG. 9 is the same as the strap 14 shown in FIGS. 1-7 illustrating the selectively fillable soft weight trainer 10. The strap 14 is stitched to the upper surface 18 by any stitching means. Preferably, a gap 30 is created between the upper surface 18 and the strap 14 that enables the person 32 to slide the hand 34 therebetween (e.g. FIG. 10). Accordingly, the hand 34 of the person 32 should snugly fit into the gap 30 such that the soft weight trainer 10 may be held securely and symmetrically. The hand 34 may clench somewhat to grasp the soft weight trainer 10. The pressure applied to a plurality of dry granules 20 (or pellets) therein enables the person 32 to slightly reposition the fingers to permit a solid, molded fit to the palm of the hand 34 of the person 32. The soft weight trainer 10 could also be filled with other low or no-impact material such as water or gel.

Figure 10:
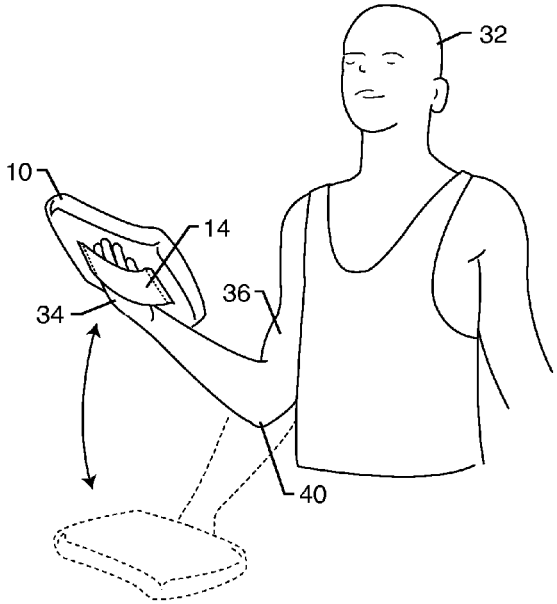
FIG. 10 is an environmental view of the soft weight trainer in use, illustrating a user performing a bicep curl with the soft weight trainer.
Figure 11:
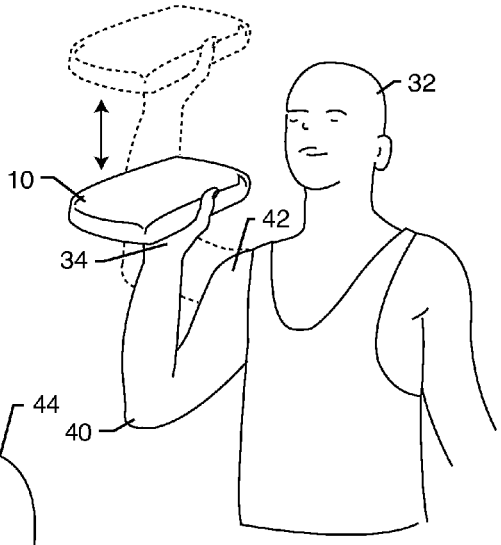
FIG. 11 is another environmental view of the soft weight trainer in use, illustrating a user performing a shoulder raise with the soft weight trainer.
Figure 12:
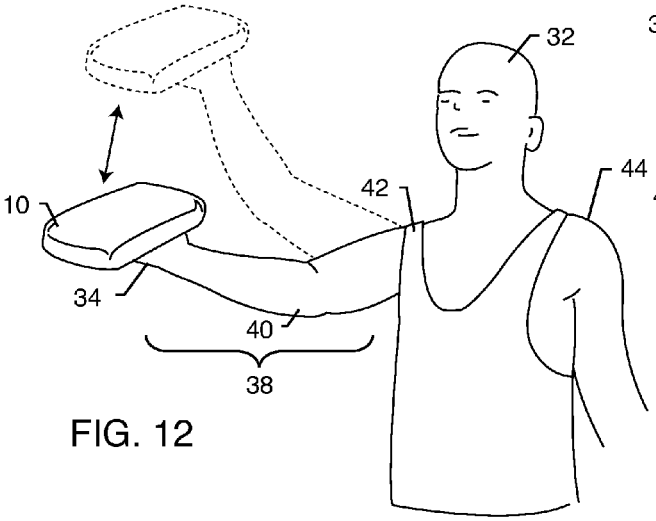
FIG. 12 is another environmental view of the soft weight trainer in use, illustrating a user performing an extended arm raise with the soft weight trainer.

As shown in FIGS. 10-12, the person 32 can use the soft weight trainer 10 as a hand-held weight. FIGS. 10-12 particularly illustrate the present invention's ability to be utilized without requiring the person 32 to form a close-fisted grip with his hand 34. In this way, the soft weight trainer 10 is particularly advantageous when used by a person 32 who has lost grip strength in his hands 34 due to age or injury. As shown in FIGS. 10-12 the soft weight trainer 10 is utilized by placing a hand 34 into the gap 30 between the upper surface of the pouch 18 and the strap 14. The hand 34 is held open and does not form a grip around the strap 14 or the pouch 12. As stated above, the hand 34 may clench somewhat in order to keep the soft weight trainer 10 stable, but no grip is required. In FIG. 10 a person 32 exercises his biceps 36 by placing his hand 34 through the gap 30 between the upper surface of the pouch 18 and the strap 14 such that the strap 14 runs across the back of his hand 34. Then with his hand 34 facing palm-up, the person 32 raises and lowers his arm 38 from the elbow 40 along the directional line as shown. In FIG. 11 a person 32 exercises the muscles of his shoulders 42 by holding the soft weight trainer 10 in a manner similar to what is described for FIG. 10. The person 32 then pushes the soft weight trainer 10 from his shoulder 42 straight up, along the directional arrow until his elbow 40 is no longer bent, all the while keeping the soft weight trainer 10 balanced on the open palm of his hand 34. In FIG. 12 a person 32 exercises the muscles of his shoulder 42 and back 44 by holding the soft weight trainer 10 in a manner similar to what is described for FIGS. 10 and 11. The person 32 then extends his arm 38 horizontally from his shoulder 42 until his elbow 40 is no longer bent. With his arm 38 thus outstretched and the soft weight trainer 10 balanced on his upward facing hand 34, the person 32 raises and lowers his entire arm 38 along the directional arrows. The soft weight trainer 10 is very safe to use because the strap 14 helps to ensure that the person 32 does not drop the soft weight trainer 10. Even if the person 32 does drop the soft weight trainer 10, the construction of the soft weight trainer 10 as described above eliminates the risk of harm due to accidental impact on the body of the person 32 because there are no hard or rigid parts contained in the soft weight trainer 10.

Figure 13:
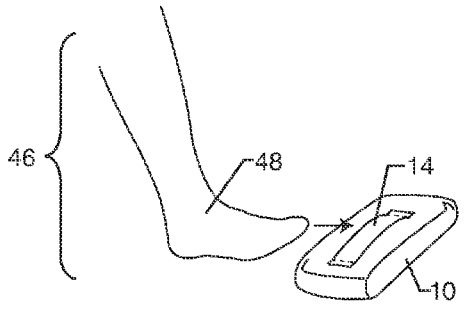
FIG. 13 is another environmental view of the soft weight trainer, illustrating a user putting his foot through the soft weight trainer strap.
Figure 14:
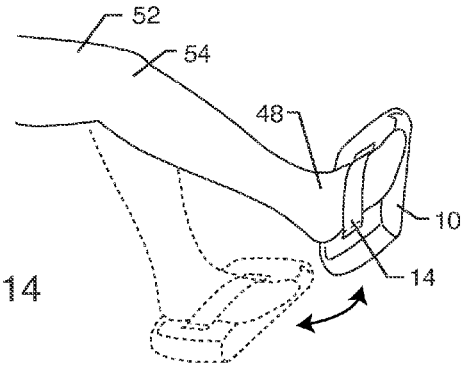
FIG. 14 is another environmental view of the soft weight trainer in use, illustrating a user performing a leg extension with the soft weight trainer.

The soft weight trainer 10 may be used in connection with hand-weighted exercises as described above, but it can also be particularly effective in exercising other areas of the body as well. FIGS. 13-18 illustrate how the soft weight trainer 10 can be utilized to exercise the muscles of the leg 46. FIG. 13 illustrates how a person 32 places his foot 48 through the gap 30 between the pouch 12 and the strap 14 of the soft weight trainer 10. The person 32 can either put his foot 48 partially through the gap 30 such that the strap 14 rests across the top of his foot 48, or he can put his foot 48 all the way through the gap 30 such that the strap 14 is situated around his ankle 50. In FIG. 14 a person 32 exercises his quadriceps 52 by placing his foot 48 partially through the gap 30 such that the strap 14 rests across the top of his foot 48. With the soft weight trainer 10 positioned accordingly and from a seated position, the person 32 raises his foot 48 until his knee 54 is no longer bent. The person 32 then lowers his foot 48 along the directional arrow until the soft weight trainer 10 is once again resting on the floor. By repeating this motion, the person's quadriceps 52 engage in an effective strengthening exercise.

Figure 15:
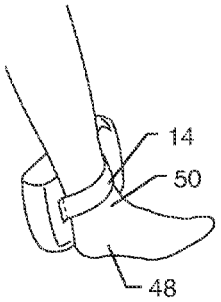
FIG. 15 is another environmental view of the soft weight trainer, illustrating the soft weight trainer fitted to the back of a user's ankle.
Figure 16:
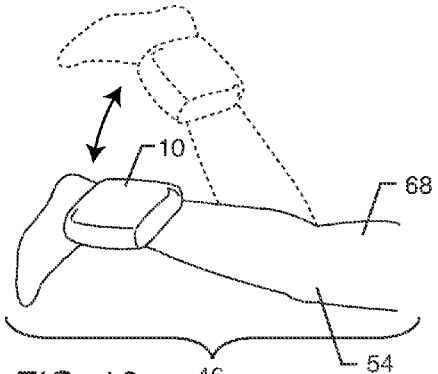
FIG. 16 is another environmental view of the soft weight trainer in use, illustrating a user performing a leg curl with the soft weight trainer.
Figure 17:
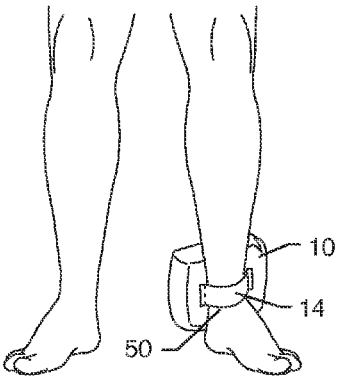
FIG. 17 is another environmental view of the soft weight trainer, similar to FIG. 15, illustrating the soft weight trainer fitted to the back of a user's ankle.
Figure 18:
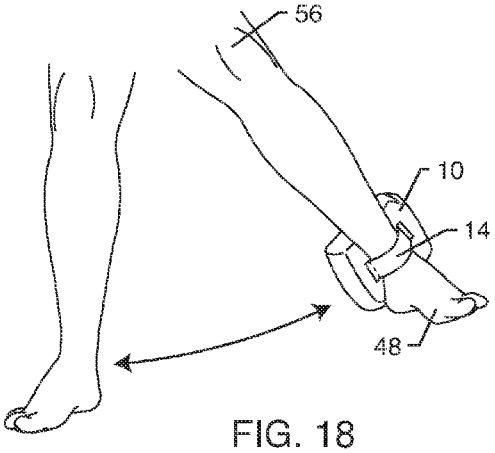
FIG. 18 is another environmental view of the soft weight trainer in use, illustrating a user performing a hip abduction with the soft weight trainer.

FIG. 15 illustrates how a different placement of the soft weight trainer 10 can enable even more leg exercises. In FIG. 15, a person 32 has placed his foot 48 all the way through the gap 30 between the pouch 12 and the strap 14 such that the strap is now positioned around his ankle 50. With the soft weight trainer 10 positioned in this manner, the user can exercise his hamstring muscle 68, as shown in FIG. 16. In FIG. 16, a person 32 positions the soft weight trainer 10 across the back of the leg 46 near the ankle 50. While lying face-down, the person 32 raises his foot 48 until his knee 54 is bent to a ninety degree angle, along the directional arrows. The person 32 then lowers his foot 48 back down until it is again resting on the floor. By repeating this motion, the person 32 can effectively exercise his hamstring muscle 68. FIG. 17 is a front view of a person's leg 46 with the soft weight trainer 10 positioned above his ankle 50. With the soft weight trainer 10 positioned in this manner, the person 32 can exercise the muscles of his hip 56, as shown in FIG. 18. In FIG. 18, the person 32 balances on one foot 48 while swinging the other foot 48 out horizontally, all the while keeping the leg 46 straight. The person 32 then lowers the foot 48 back to the ground. By repeating this motion, the person 32 can effectively exercise the muscles of his hips 56.

Figure 19:
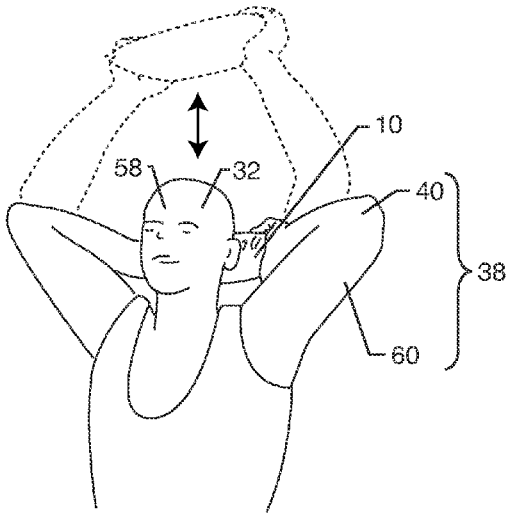
FIG. 19 is another environmental view of the soft weight trainer in use, illustrating a user performing triceps extension with the soft weight trainer.
Figure 20:
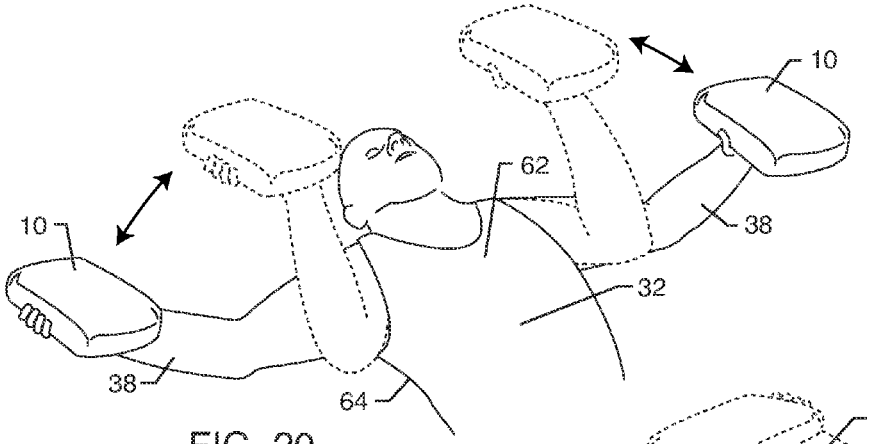
FIG. 20 is another environmental view of the soft weight trainer in use, illustrating a user performing chest flys with the soft weight trainer.
Figure 21:
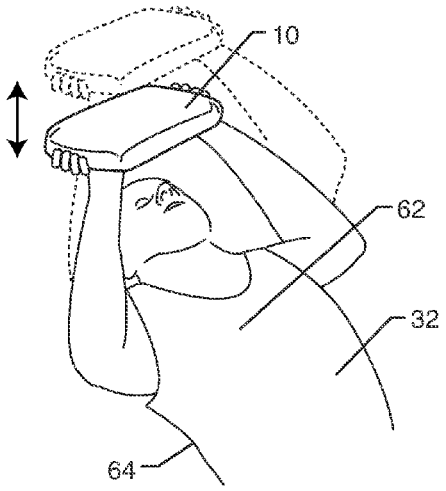
FIG. 21 is another environmental view of the soft weight trainer in use, illustrating a user performing a chest press with the soft weight trainer.

While the exercises described above require the use of the strap 14 in order to be performed, many exercises can be performed with the soft weight trainer 10 that do not require the use of the strap 14. FIGS. 19-21 illustrate exercises that do not require the use of the strap 14, but rather can be performed by a person 32 grasping the outer edges of the soft weight trainer 10. For example, FIG. 19 illustrates a person 32 grasping the outer edges of the soft weight trainer 10 and positioning the soft weight trainer 10 behind his head 58. From here, the person 32 extends his arms 38 while still grasping the soft weight trainer 10 until his elbows 40 are no longer bent. He then returns the soft weight trainer 10 to its starting position behind his head 58. By repeating this motion, the person 32 can effectively exercise his triceps 60. Another non-strap exercise is illustrated in FIG. 20 where a person 32 exercises the muscles of his chest 62 by grasping two soft weight trainers 10 and lying on his back 64 with his arms 38 outstretched as shown. From this position, the person 32 brings his hands together until the soft weight trainers 10 are above his chest 62. By repeating this motion, the person 32 can effectively exercise the muscles of his chest 62. Another chest exercise is illustrated in FIG. 21 where the person 32 grasps the outer edges of the soft weight trainer 10 and while lying on his back 64, pushes the soft weight trainer 10 directly away from his chest 62.

Figure 22:
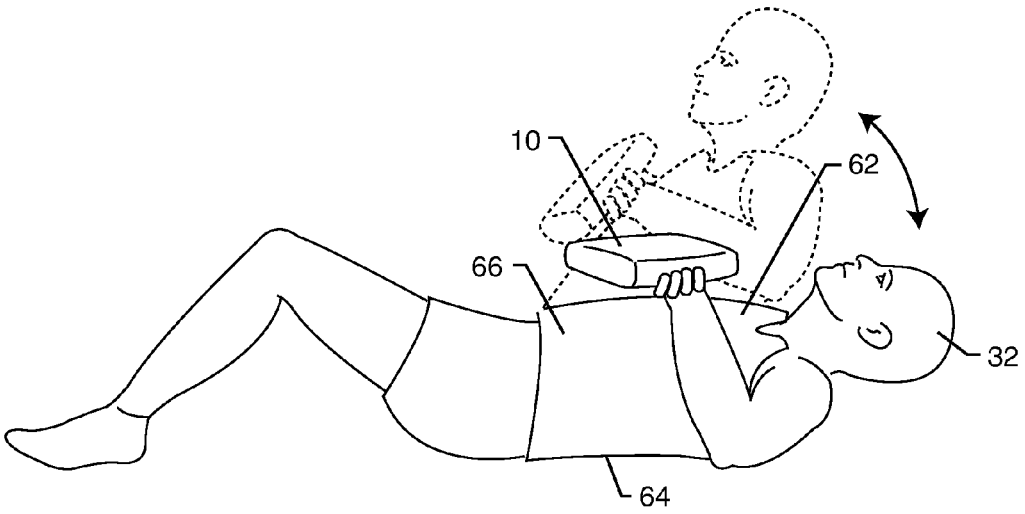
FIG. 22 is another environmental view of the soft weight trainer in use, illustrating a user performing an abdominal crunch with the soft weight trainer.
Figure 23:
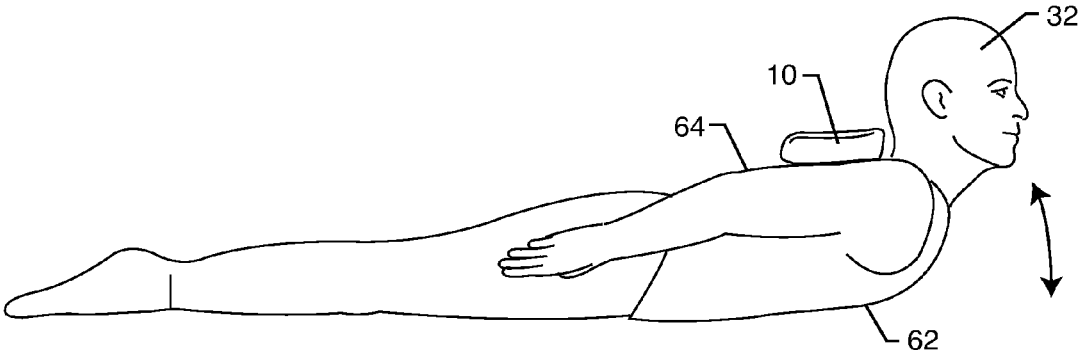
FIG. 23 is another environmental view of the soft weight trainer in use, illustrating a user performing a back extension with the soft weight trainer.

In addition to being used with the strap 14 or by grasping with the hands, the soft weight trainer 10 can also be used by balancing it on certain parts of the body while performing exercises. In FIG. 22, a person 32 exercises the muscles of his abdominals 66 by placing the soft weight trainer 10 on his chest 62 while he is lying on his back 64. From this position, the person 32 contracts his abdominals 66 until his upper back 64 is off the ground, along the directional arrows. The person 32 then returns to his initial position. This exercise can be repeated to effectively tone the abdominal muscles 66. FIG. 23 shows another exercise where the soft weight trainer 10 is placed across the upper back 64 of a person 32 while the person 32 is laying face-down. With the soft weight trainer 10 in this position, the person 32 then contracts the muscles of his back 64 until his upper chest 62 comes off the ground, along the directional arrows. The person 32 then releases the muscles of his back 64 and lowers his upper chest 62 to the ground. Repeating this motion strengthens the muscles of the back 64.

Figure 24:
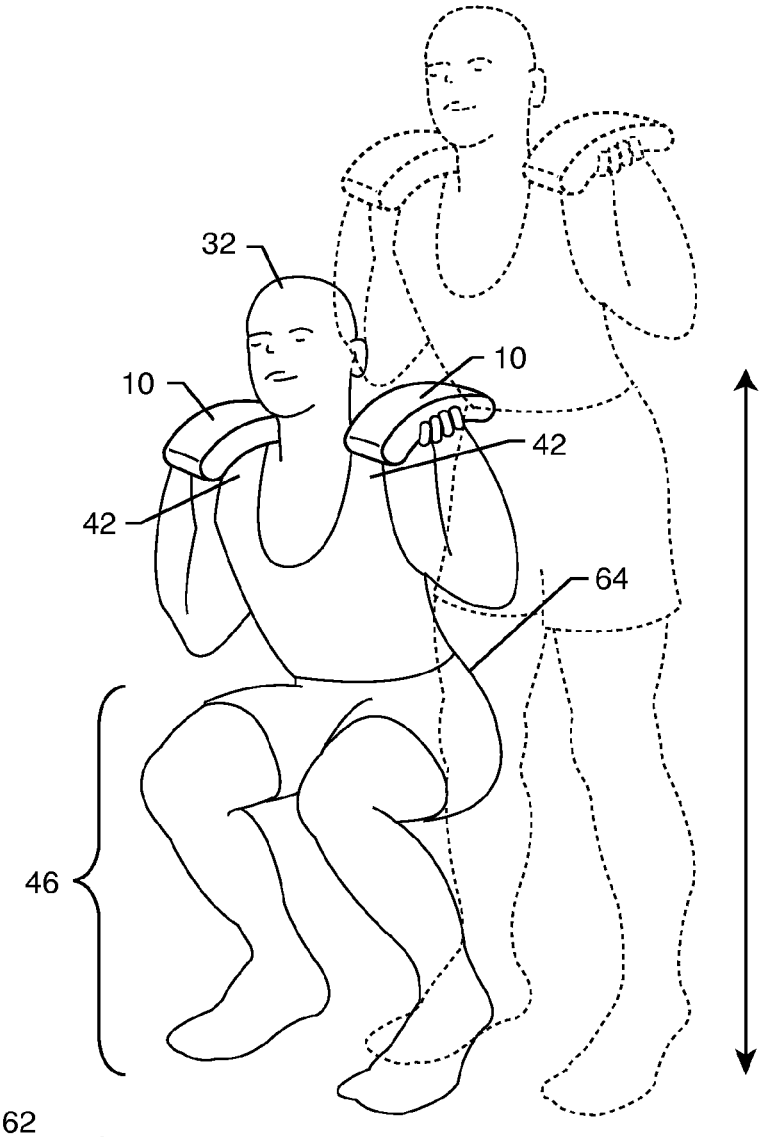
FIG. 24 is another environmental view of the soft weight trainer in use, illustrating a user performing a side twist with the soft weight trainer.
Figure 25:
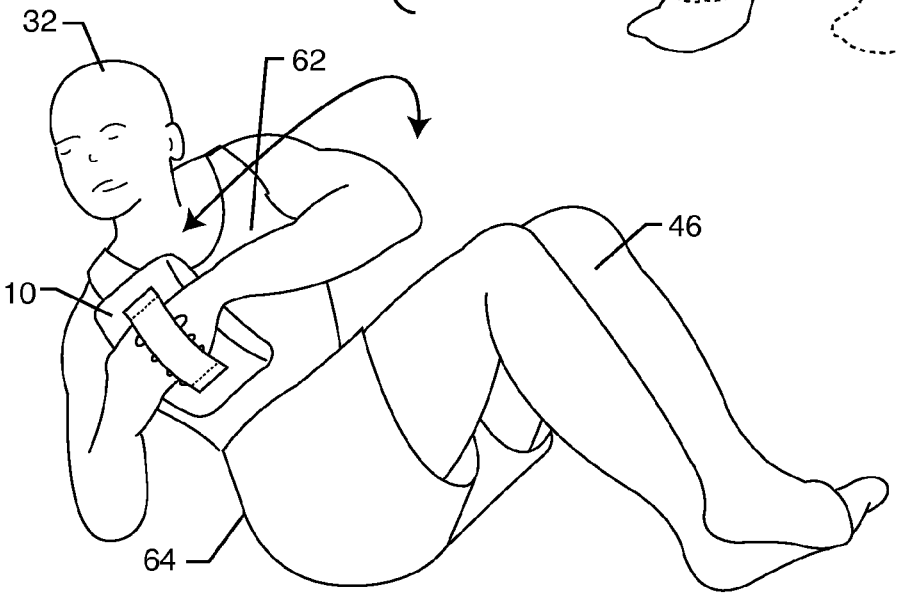
FIG. 25 is another environmental view of the soft weight trainer in use, illustrating a user performing squats with the soft weight trainer.

Other exercises that are performed by placing the soft weight trainer 10 on various areas of the body are illustrated in FIGS. 24-25. In FIG. 24 a person 32 places two soft weight trainers 10 on his shoulders 42. With the soft weight trainers 10 positioned in this manner, the person 32 raises and lowers himself from a squatting to a standing position, along the directional arrow. This motion effectively strengthens the muscles of the legs 46 and the lower back 64. Another abdominal exercise is illustrated in FIG. 25 where a person 32 presses the soft weight trainer 10 to his chest 62. He then balances on his lower back 64 with his legs 46 partially bent. From this position, the person 32 twists his upper torso 62 from side to side, along the directional arrows. This motion effectively strengthens the abdominal muscles 66.

As has been shown, the soft weight trainer 10 of the present invention offers several advantages over other weight trainers. The soft weight trainer 10 can be selectively filled or emptied making it ideal for travel or storage when not in use. The soft weight trainer 10 can hold a variety of low density granular materials 20. In use, the soft weight trainer 10 is safer than traditional metal weights because it will not cause damage or injury if accidentally dropped. Additionally, the soft weight trainer 10 is ideal for use by persons who cannot form a close-fisted grip due to age or injury.

Although several embodiments have been described in detail for purposes of illustration, various modifications may be made to each without departing from the scope and spirit of the invention. Accordingly, the invention is not to be limited, except as by the appended claims.

What is claimed is:

1. A soft weight strength trainer, comprising:

a fillable, flexible pouch for holding a low density granular material therein;

a sleeve extending from the pouch for passing the low density granular material into and out of the pouch;

a pair of selectively engageable internal sealers disposed on an inner surface of the sleeve adjacent to the pouch, for selectively sealing the sleeve and the pouch such that the low density granular material is effectively retained within the pouch;

a pair of selectively engageable external sealers disposed on an exterior surface of the sleeve, wherein a first external sealer is disposed immediately opposite one of the internal sealers, and a second external sealer is spaced from the first external sealer such that the sleeve, having no low density granular material therein, may be folded on itself to form a second seal which prevents the escape of material within the pouch through the sleeve; and a webbed strap integrally formed with or attached to the pouch so as to form a gap between the strap and the pouch so that the pouch may be supported and manipulated without forming a closed grip.

2. The strength trainer of claim 1, wherein the pouch is made of a waterproof woven nylon.

3. The strength trainer of claim 1, wherein the low density granular material is a fine mesh filler, sand, dirt, rice, beans, silica, or salt.

4. The strength trainer of claim 1, including a first body sealer disposed on an opposite outer surface of the sleeve relative to the external sealers, and a second body sealer disposed on an outer surface of the pouch, such that the first body sealer may be selectively engaged with the second body sealer so as to provide a third pouch seal.

5. The strength trainer of claim 1, comprising multiple pairs of internal sealers disposed on an inner surface of the sleeve.

6. The strength trainer of claim 1, comprising multiple pairs of external sealers disposed on an external surface of the sleeve.

7. The strength trainer of claim 1, wherein the internal sealers and the external sealers comprise hook and loop tape.

8. The strength trainer of claim 1, wherein the webbed strap enables a portion of a foot, a leg, an arm or a hand without a closed grip to be placed within the gap between the strap and the pouch so as to support and manipulate the pouch without forming a closed grip.

9. A strength training process, comprising the steps of:

providing a flexible pouch having a sleeve extending therefrom for passing a low density granular material into and out of the pouch, and a strap forming a gap between the strap and an outer surface of the pouch;

filling the pouch with the low density granular material;

sealing the sleeve such that the low density granular material is contained within the pouch, including the steps of engaging a pair of internal sealers disposed on an inner surface of the sleeve adjacent to the pouch, folding the sleeve on itself opposite the pair of internal sealers relative to the pouch, and engaging a pair of external sealers disposed on an outer surface of the sleeve; wherein the step of engaging a pair of external sealers disposed on an outer surface of the sleeve comprises the steps of disposing a first external sealer immediately opposite one of the internal sealers, disposing a second sealer in spaced relation from the first external sealer, and folding the portion of the sleeve between the external sealers having no low density granular material therein on itself to form a second seal; and performing strength training exercises utilizing the filled pouch by inserting a portion of an arm or a hand without a closed grip in the gap between the strap and the pouch and moving the hand or arm such that the muscles of the arm are exercised.

10. The strength training process of claim 9, wherein the filling step includes the step of using fine mesh fillers, sand, dirt, rice, beans, silica, or salt.

11. The strength training process of claim 9, further comprising the steps of unsealing and emptying the filled pouch.

12. The strength training process of claim 11, further comprising the step of collapsing the pouch for storage or transport.

13. The strength training process of claim 9 wherein the internal and external sealers are comprised of hook and loop tape.

14. The strength training process of claim 9, wherein the sealing step further includes the step of folding the sleeve a second time and engaging a first body sealer disposed on an outer surface of the sleeve with a second body sealer disposed on an outer surface of the pouch.

15. The strength training process of claim 14, wherein the first and second body sealers comprise hook and loop tape.

* * * * *